US009207551B2

(12) United States Patent
Sakai et al.

(10) Patent No.: US 9,207,551 B2
(45) Date of Patent: Dec. 8, 2015

(54) BRILLIANT TONER, ELECTROSTATIC CHARGE IMAGE DEVELOPER, TONER CARTRIDGE, AND PROCESS CARTRIDGE

(71) Applicant: FUJI XEROX CO., LTD., Tokyo (JP)

(72) Inventors: Motoko Sakai, Kanagawa (JP); Akihiro Iizuka, Kanagawa (JP); Mona Tasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/463,033

(22) Filed: Aug. 19, 2014

(65) Prior Publication Data

US 2015/0268570 A1 Sep. 24, 2015

(30) Foreign Application Priority Data

Mar. 20, 2014 (JP) ..... 2014-058854

(51) Int. Cl.
*G03G 9/097* (2006.01)
*G03G 9/08* (2006.01)

(52) U.S. Cl.
CPC ..... *G03G 9/08* (2013.01); *G03G 9/0819* (2013.01); *G03G 9/0827* (2013.01)

(58) Field of Classification Search
CPC G03G 9/09708; G03G 9/0819; G03G 9/0827
See application file for complete search history.

(56) References Cited

U.S. PATENT DOCUMENTS

| | | | | |
|---|---|---|---|---|
| 5,891,600 | A | 4/1999 | Okuno et al. | |
| 2011/0318063 | A1 | 12/2011 | Takahashi et al. | |
| 2011/0318682 | A1* | 12/2011 | Takahashi | G03G 9/0819 430/105 |
| 2013/0137030 | A1* | 5/2013 | Sato | G03G 9/0819 430/108.11 |

FOREIGN PATENT DOCUMENTS

| | | |
|---|---|---|
| JP | A-10-115947 | 5/1998 |
| JP | A-2006-23694 | 1/2006 |
| JP | A-2012-32765 | 2/2012 |

* cited by examiner

*Primary Examiner* — Hoa V Le
(74) *Attorney, Agent, or Firm* — Oliff PLC

(57) ABSTRACT

A brilliant toner includes flake shape toner particles containing a binder resin and a flake shape metallic pigment. The brilliant toner further includes tabular particles containing a Ti element.

11 Claims, 4 Drawing Sheets

BRILLIANT TONER, ELECTROSTATIC CHARGE IMAGE DEVELOPER, TONER CARTRIDGE, AND PROCESS CARTRIDGE

CROSS-REFERENCE TO RELATED APPLICATIONS

This application is based on and claims priority under 35 USC 119 from Japanese Patent Application No. 2014-058854 filed Mar. 20, 2014.

BACKGROUND

1. Technical Field

The present invention relates to brilliant toner, an electrostatic charge image developer, a toner cartridge, and a process cartridge.

SUMMARY

According to an aspect of the invention, there is provided a brilliant toner including:

flake shape toner particles containing a binder resin, and a flake shape metallic pigment; and tabular particles containing a Ti element.

BRIEF DESCRIPTION OF THE DRAWINGS

Exemplary embodiments of the present invention will be described in detail based on the following figures, wherein:

FIGS. 1A and 1B are schematic views showing toner particles which lie due to a physical force of a fixing member, in which FIG. 1A shows a case of using toner including toner particles which are easily aggregated and FIG. 1B shows a case of using toner including toner particles which are hardly aggregated;

DETAILED DESCRIPTION

Hereinafter, exemplary embodiments of a brilliant toner, an electrostatic charge image developer, a toner cartridge, a process cartridge, an image forming apparatus, and an image forming method of the invention will be described in detail.

Brilliant Toner

The brilliant toner of the exemplary embodiment (hereinafter, referred to as "toner" in some cases) includes: flake shape toner particles containing a binder resin and a flake shape metallic pigment; and particles containing a Ti element (hereinafter, referred to as a "Ti-containing particles" in some cases).

Since the brilliant toner of the exemplary embodiment has the configuration described above, an image having a high brilliance is obtained even after deterioration of the toner, compared to the toner not including the Ti-containing particles (for example, toner formed of toner particles or toner using particles containing an Si element instead of the Ti-containing particles). The reason thereof is not clear but may be assumed as follows.

It is found that, as in the exemplary embodiment, in a case of performing image forming using the toner including flake shape toner particles and containing a metallic pigment, in a step of transferring a toner image onto a recording medium, the transferred toner particles are in an upright state (that is, a state in which a long axis direction of the toner particles is closer to a direction orthogonal to a surface of the recording medium than a direction parallel with the surface of the recording medium) due to a transfer electric field. The toner particles in the upright state lie due to a physical force of a fixing member which contacts a toner image in a fixing step of fixing the toner image onto the recording medium.

The "long axis direction" herein means a direction of the longest axis.

The brilliance of the fixed image is dependent on orientation and arrangement of the toner particles in the fixed image. In detail, as the toner particles are oriented in a state where the long axis direction thereof is close to the direction parallel with the surface of the recording medium and the toner particles are densely disposed in an image portion, a high brilliance is obtained. The orientation and arrangement of the toner particles in the fixed image are dependent on easiness of aggregation of the toner particles.

Figure 1A:
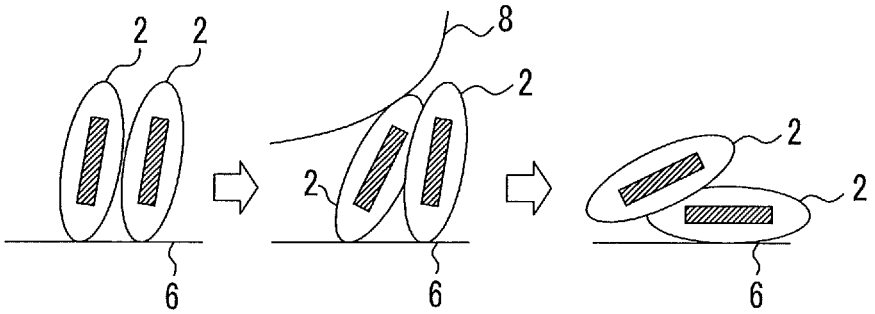
Figure 1B:
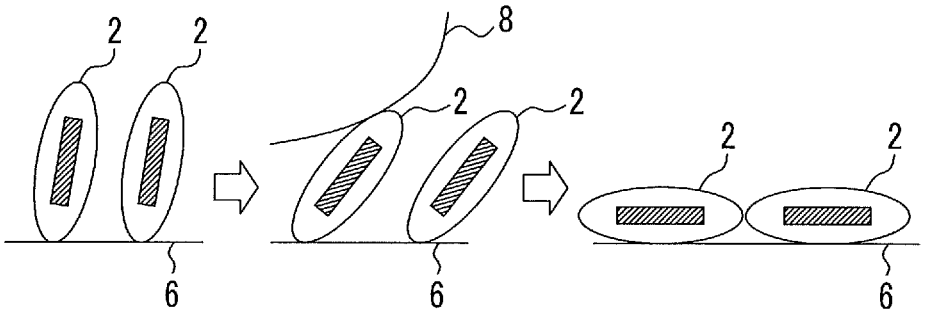

FIGS. 1A and 1B schematically show the toner particles in the upright state on the surface of the recording medium which lie due to the physical force of the fixing member, in a case of using toner including toner particles which are easily aggregated (FIG. 1A) and a case of using toner including toner particles which are hardly aggregated (FIG. 1B).

As shown in FIG. 1A, in a case where the toner particles are easily aggregated, toner particles 2 transferred onto a surface of a recording medium 6 are aggregated in the upright state, and accordingly the toner particles 2 are unlikely to lie even when the physical force is applied by a fixing member 8, and the toner particles are easily overlapped with each other. Therefore, even after the fixing step, it is difficult to set the long axis direction of the toner particles 2 to follow the direction parallel with the surface of the recording medium 6, and the toner particles 2 are easily disposed in a biased manner.

Meanwhile, as shown in FIG. 1B, in a case where the toner particles are hardly aggregated, the toner particles 2 transferred onto the surface of the recording medium are arranged at intervals, and accordingly, the toner particles 2 easily lie due to the physical force of the fixing member 8 and are easily arranged not to be overlapped with each other. Therefore, the toner particles 2 are easily oriented in a state where the long axis direction thereof is close to the direction parallel with the surface of the recording medium 6, and the toner particles 2 are easily evenly disposed in the image portion.

In the toner, the toner particles are easily aggregated in general, along with the proceeding of deterioration. In detail, for example, in some cases, an external additive is embedded in the toner particles due to a physical load applied to the toner by stirring or the like in a developer unit, and the action of the external additive of physically reducing an adhesive force between the toner particles is not obtained, and therefore the toner particles may be easily aggregated. Particularly, in a case where the toner particles have a flake shape, a contact area of toner particles is large, and accordingly the aggregation due to the deterioration of the toner is significant.

With respect thereto, since the Ti-containing particles are used as the external additive in the exemplary embodiment, the Ti-containing particles allows the charge stored in the toner particles to leak, an electrostatic adhesive force between the toner particles is reduced, and accordingly the toner particles are hardly aggregated. The reduction of the electrostatic adhesive force performed by the Ti-containing particles is not a physical action but an electrical action, and therefore it is exhibited even when the Ti-containing particles used as the external additive are embedded in the toner particles. In addition, the Ti-containing particles are hardly separated from the toner particles when the Ti-containing particles are embedded in the toner particles, and accordingly it is easy to obtain the effect of the reduction of the electrostatic adhesive force.

As described above, in the exemplary embodiment, it is expected that the aggregation of toner particles hardly occurs even after the deterioration of the toner and accordingly an image having a high brilliance is obtained, compared to a case of not using the Ti-containing particles.

When an average of an equivalent circle diameter (hereinafter, referred to as an "average equivalent circle diameter" in some cases) of a surface with a maximum projection area of the toner particles (hereinafter, referred to as a "flake surface" in some cases) is set as D (μm) and an average of maximum values of a thickness orthogonal to the flake surface (hereinafter, referred to as an "average maximum thickness" in some cases) is set as C (μm), the phrase "the toner particles have a flake shape" in the exemplary embodiment means that a value of C is smaller than a value of D.

Herein, the average maximum thickness C and the average equivalent circle diameter D of the toner particles are measured with the following method.

The toner is applied to a flat surface and dispersed with vibration so as not to have unevenness. 1000 toner particles are observed with a color laser microscope "VK-9700" (manufactured by Keyence Corporation) with a magnification power of 1000, the maximum thickness C and the equivalent circle diameter D of a top view are measured, and arithmetic average values thereof are calculated to acquire the average maximum thickness C and the average equivalent circle diameter D.

In the same manner as in the case of the toner particles, the phrase "the metallic pigment has a flake shape" in the exemplary embodiment means that the average maximum thickness C is smaller than the average equivalent circle diameter D.

The observation of the average maximum thickness C and the average equivalent circle diameter D of the metallic pigment is also performed in the same manner as in the case of the toner particles, the maximum thickness C and the equivalent circle diameter D of a top view of the brilliant pigment contained in the toner particles are measured, and arithmetic average values thereof are calculated to acquire the average maximum thickness C and the average equivalent circle diameter D.

The "brilliance" in the exemplary embodiment means that brilliance such as metallic gloss is obtained when the formed image is visually observed.

As an image having a brilliance, an image which has a ratio (A/B) of a reflectance A at a light receiving angle of +30° and a reflectance B at a light receiving angle of −30°, measured with the image which is irradiated with incident light at an angle of incidence of −45° by a goniophotometer, is from 2 to 100

The value of the ratio (A/B) which is equal to or more than 2 represents that the reflection at the side opposite the incident light (side of the positive light receiving angle) is greater than the reflection at the side of the incident light (side of the negative light receiving angle) and diffuse reflection of the incident light is suppressed. Ina case where the diffuse reflection that incident light is reflected to various directions occurs, the color appears to be darkened when visually observing the reflected light thereof. Accordingly, when the ratio (A/B) is equal to or more than 2, the gloss is confirmed and the excellent brilliance is obtained when visually observing the reflected light thereof.

Meanwhile, if the ratio (A/B) is equal to or less than 100, a viewing angle with which the reflected light can visually observed is not excessively narrow, and accordingly, a phenomenon in which the color appears to be black depending on an angle is unlikely to occur.

The ratio (A/B) described above is more preferably from 20 to 90 and particularly preferably from 40 to 80.

In addition, as described above, in the exemplary embodiment, an image having a high brilliance is obtained even after deterioration of the toner. The ratio (A/B) of the image formed after the deterioration of the toner is preferably 2 to 100 and particularly preferably 40 to 80.

Measurement of Ratio (A/B) with Goniophotometer

Herein, first the angle of incidence and the light receiving angle will be described. When measuring the ratio with the goniophotometer in the exemplary embodiment, the angle of incidence is set to −45°, and this is because high measurement sensitivity is obtained with respect to an image with a wide range of glossiness.

In addition, the light receiving angle is set to −30° and to +30° because the measurement sensitivity is highest when evaluating an image with a brilliance and an image with no brilliance.

Next, a method of measuring the ratio (A/B) will be described.

In the exemplary embodiment, when measuring the ratio (A/B), first, a "solid image" is formed with the following method. A developer unit of a DocuCentre-III C7600 manufactured by Fuji Xerox Co., Ltd. is filled with a developer that is a sample, and a solid image having a toner applied amount of 4.5 g/cm$^2$ is formed on a recording sheet (OK TopCoat plus, manufactured by Oji Paper Co., Ltd.) at a fixing temperature of 190° C. and a fixing load of 4.0 kg/cm$^2$. The "solid image" indicates an image having coverage rate of 100%.

The incident light at an angle of incidence of −45° with respect to the solid image is applied to an image part of the formed solid image, and a reflectance A at a light receiving angle of +30° and a reflectance B at a light receiving angle of −30° are measured by using a spectral varied angle color-difference meter GC5000L as a goniophotometer manufactured by Nippon Denshoku Industries Co., Ltd. Each of the reflectance A and the reflectance B is measured regarding the light having a wavelength of 400 nm to 700 nm at intervals of 20 nm, and defined as an average of the reflectances at respective wavelengths. The ratio (A/B) is calculated from these measurement results.

From the viewpoint of satisfying the above-described ratio (A/B), the brilliant toner according to the exemplary embodiment preferably satisfies the following requirements (1) and (2).

(1) The toner particles have an average equivalent circle diameter D longer than an average maximum thickness C.

(2) When cross sections of toner particles in a thickness direction are observed, a rate of a metallic pigment in which an angle between a long axis direction of the toner particles in the cross section and a long axis direction of the metallic pigment is from −30° to +30° is 60% or greater with respect to the total metallic pigments that are observed.

Figure 2:
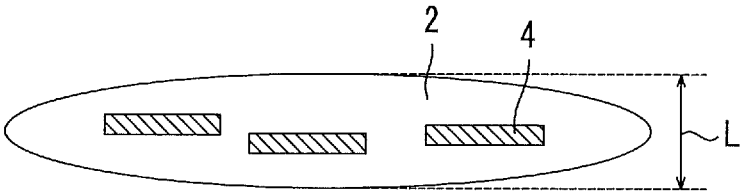
FIG. 2 is a cross-sectional view schematically showing an example of toner particles of an exemplary embodiment.

Herein, FIG. 2 shows a cross-sectional view schematically showing an example of toner particles satisfying the requirements (1) and (2) described above. The schematic view shown in FIG. 2 is a cross-sectional view of the toner particles in a thickness direction thereof.

A toner particle 2 shown in FIG. 2 is a long and flake shape toner particle having an equivalent circle diameter larger than a thickness L, and contains flake-shape metallic pigments 4.

As described above, in the exemplary embodiment, the flake shape toner particles are arranged so that the flake surface sides thereof face the surface of the recording medium (direction close to the parallel direction) due to the physical pressure from the fixing member in the fixing step.

Therefore, among the flake shape metallic pigments contained in the toner particle, metallic pigment that satisfy "an angle between a long axis direction of the toner in the cross section and a long axis direction of the brilliant pigment particle is from −30° to +30°" described in the requirement (2) are arranged so that the surface side that provides the maximum area faces the surface of the recording medium (direction close to the parallel direction). When the image formed in this manner is irradiated with light, the proportion of the brilliant pigment particles that causes diffuse reflection of the incident light is suppressed, and thus the above-described range of the ratio (A/B) is easily achieved.

In the exemplary embodiment, the moisture content of the Ti-containing particles is preferably from 1% by weight to 10% by weight.

When the Ti-containing particles having the moisture content of the range described above are used, an image having a high brilliance is obtained even after deterioration of the toner, compared to a case where the moisture content is beyond the range described above. The reason thereof is not clear, but it is assumed that, when the Ti-containing particles contain a specific quantity of moisture, a high charge exchanging property with low resistance is obtained and the charge of the toner particles easily leaks, compared to a case where the moisture content described above is smaller than the range described above. Therefore, as described above, an electrostatic adhesive force between the toner particles is reduced and the toner particles are hardly aggregated, and an image having a high brilliance is obtained even after deterioration of the toner.

In addition, it is considered that, when the moisture content of the Ti-containing particles is in the range described above, the aggregation of the Ti-containing particles caused by the moisture hardly occurs, compared to a case where the moisture content described above is larger than the range described above. Accordingly, since the Ti-containing particles are externally evenly added to the surface of the toner particles, it is assumed that the effect of the reduction of the electrostatic adhesive force due to the Ti-containing particles is easily obtained, and as a result, an image having a high brilliance is obtained even after deterioration of the toner.

Herein, the moisture content of the Ti-containing particles is measured with the following method.

The moisture content thereof is measured by using a heat analysis device DTG-60AH (manufactured by Shimadzu Corporation). In the pretreatment, vacuum drying is performed at 100° C. for 24 hours, for example. In detail, for example, the pressure is reduced to −0.1 MPa and drying is performed at 100° C. for 24 hours with VOS-301SD (manufactured by TOKYO RIKAKIKIKAI Co., Ltd.) After that, after holding the particles under the nitrogen atmosphere (30 ml/min) at 30° C. for 1 hour, the temperature is increased at a rate of temperature rise of 30° C./min, and a rate of the moisture quantity with respect to all of the Ti-containing particles is acquired from loss on heating at a temperature of 30° C. to 250° C. and used as the moisture content (% by weight).

The moisture content of the Ti-containing particles is more preferably from 2% by weight to 8% by weight and even more preferably from 3% by weight to 6% by weight.

As a method of controlling the moisture content of the Ti-containing particles, the following method is used. In detail, for example, there is a method of controlling the moisture content by preparing the Ti-containing particles with a wet-type preparing method and, changing the drying temperature or the surface processing conditions.

In the exemplary embodiment, a number average particle size of the Ti-containing particles is preferably from 7 nm to 50 nm.

When the Ti-containing particles having the number average particle size of the range described above are used, an image having a high brilliance is obtained even after deterioration of the toner, compared to a case where the number average particle size is greater than the range described above. The reason thereof is not clear, but when the number average particle size of the Ti-containing particles is in the range described above, the Ti-containing particles are easily and strongly attached to and are easily embedded in the toner particles, compared to a case where the number average particle size is greater than the range described above. Accordingly, it is assumed that the effect of the reduction of the electrostatic adhesive force due to the Ti-containing particles is easily obtained, and as a result, an image having a high brilliance is obtained even after deterioration of the toner.

As the number average particle size of the Ti-containing particles is small, the Ti-containing particles are easily and strongly attached to the toner particles, but the number average particle size thereof is preferably equal to or greater than 7 nm, from a viewpoint of practical availability.

Herein, the number average particle size of the Ti-containing particles is measured with the following method.

In detail, the surface of toner particles is observed with an electron scanning microscope (SEM (S4700) manufactured by Hitachi, Ltd.) with a magnification power of 40000, images of 100 Ti-containing particles existing on an outer periphery of the toner particles is analyzed by using an image processing analysis software WinRoof (manufactured by MITANI CORPORATION), an average of the obtained equivalent circle diameters of the Ti-containing particles is obtained, and the number average particle size thereof is calculated.

The number average particle size of the Ti-containing particles is more preferably from 10 nm to 30 nm.

In the exemplary embodiment, the Ti-containing particles preferably have a tabular shape.

When the tabular Ti-containing particles are used, an image having a high brilliance is obtained even after deterioration of the toner, compared to a case where the Ti-containing particles which do not have a tabular shape (for example, spherical Ti-containing particles) are used. The reason thereof is not clear, but when the Ti-containing particles have a tabular shape, the Ti-containing particles have a large contact area with the toner particles and are easily and strongly attached to the toner particles. Accordingly, it is assumed that the effect of the reduction of the electrostatic adhesive force due to the Ti-containing particles is easily obtained, and as a result, an image having a high brilliance is obtained even after deterioration of the toner.

The phrase "Ti-containing particles have a tabular shape" herein means that a ratio (hereinafter, referred to as "ratio of height/long axis" in some cases) of the height of the Ti-containing particles (length of shortest axis among the axis orthogonal to the long axis) with respect to the length of the long axis of the Ti-containing particles (length of longest axis) is equal to or smaller than 0.8.

The length of the long axis and the height of the Ti-containing particles are acquired by observing with the SEM and analyzing with the image processing analysis software, in the same manner as in the measurement of the number average particle size of the Ti-containing particles. In detail, the "ratios of height/long axis" of 100 Ti-containing particles existing on an outer periphery of the toner particles are acquired from the images and the average thereof is obtained.

The value of the "ratio of height/long axis" of the Ti-containing particles is preferably equal to or smaller than 0.7, and more preferably from 0.1 to 0.5. When the "ratio of height/long axis" of the Ti-containing particles is equal to or greater than 0.1, the contact area of each particle of the Ti-containing particles and the toner surface becomes great, and therefore it is advantageous to easily evenly disperse on the toner surface. In addition, when the "ratio of height/long axis" of the Ti-containing particles is equal to or smaller than 0.7, the Ti-containing particles are easily strongly attached to the toner particles and the effect of the reduction of the electrostatic adhesive force due to the Ti-containing particles is easily exhibited, compared to a case where the ratio thereof is greater than 0.7.

As a method of controlling the shape of the Ti-containing particles and adjusting the value of the "ratio of height/long axis", a method of selecting a composition with which a target shape is obtained, is used, for example. In addition, in a case of using titanium oxide particles as the Ti-containing particles, for example, a method of controlling a crystalline structure and controlling the shape of the Ti-containing particles is also used.

The value of the ratio of height/long axis of the Ti-containing particles is greater than the value of a ratio (C/D) of the average maximum thickness C and the average equivalent circle diameter D of the toner particles.

The value of the ratio of height/long axis of the Ti-containing particles is in a range of 1.1 times to 25 times the value of the ratio (C/D) of the average maximum thickness C and the average equivalent circle diameter D of the toner particles.

Hereinafter, the toner according to the exemplary embodiment will be described.

The toner according to the exemplary embodiment includes the toner particles and the Ti-containing particles, and if necessary, may include other components.

Toner Particles

The toner particles are configured to include a binder resin and a flake shape metallic pigment, and if necessary, may include a release agent and other additives.

Metallic Pigment

As the metallic pigment, metallic powder such as aluminum, brass, bronze, nickel, stainless steel, zinc or the like is used, and there is no particular limitation as long as it is a pigment containing metal. The metallic pigment may be used alone or in combination with two or more kinds thereof.

Among the metallic pigments, particularly from a viewpoint of availability and easy flattening of the toner particles, aluminum is most preferable. The surface of the metallic pigment may be coated with silica particles, an acrylic resin, or a polyester resin.

The content of the metallic pigment with respect to the toner particles is, for example, preferably from 1 part by weight to 70 parts by weight and more preferably from 5 parts by weight to 50 parts by weight, with respect to 100 parts by weight of the binder resin which will be described later.

As described above, the metallic pigment has a flake shape.

The value of the ratio (C/D) of the metallic pigment is preferably 0.700 or less, more preferably from 0.005 to 0.1, and even more preferably from 0.01 to 0.1. When the ratio (C/D) of the metallic pigment is equal to or greater than 0.005, it is advantageous because the strong resistance is obtained with respect to stirring stress when granulating the toner. In addition, when the ratio (C/D) of the metallic pigment is equal to or smaller than 0.700, a high brilliance is easily obtained, compared to a case where the ratio thereof is greater than 0.700.

Binder Resin

Examples of the other binder resins include a homopolymer of a monomer such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of the monomers.

Examples of the binder resin include a non-vinyl resin such as an epoxy resin, a polyester resin, a polyurethane resin, a polyamide resin, a cellulose resin, a polyether resin, and modified rosin, a mixture of these and the vinyl resin, or a graft polymer obtained by polymerizing the vinyl monomer under coexistence thereof.

These binder resins may be used alone or in combination with two or more kinds thereof.

As the binder resin, a polyester resin is preferable.

As the polyester resin, a well-known polyester resin is used, for example.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

A glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC), and more specifically, is acquired by "extrapolation glass transition starting temperature" disclosed in a method of acquiring the glass transition temperature of JIS K7121-1987 "Testing Methods for Transition Temperature of Plastics".

A weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using HLC-8120 GPC, which is GPC manufactured by Tosoh Corporation as a measurement device by using TSKgel Super HM-M (15 cm), which is a column manufactured by Tosoh Corporation. The weight average molecular weight and the number average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and even more preferably from 60% to 85% by weight, with respect to the entire toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K7121-1987 "Testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

In addition, as the other additives, the other colorant other than the metallic pigment may be included. As the other colorant, a well-known colorant is used, and the colorant is selected depending on a desirable color.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin, and if necessary, other additives such as a colorant and a release agent and a coating layer containing a binder resin.

Average Maximum Thickness C and Average Equivalent Circle Diameter D of Toner Particles As described above, the toner particles have a flake shape. That is, the value of the average maximum thickness C is smaller than the value of the average equivalent circle diameter D.

In addition, the value of the ratio (C/D) of the toner particles is preferably equal to or smaller than 0.700, more preferably from 0.001 to 0.500, even more preferably from 0.010 to 0.200, and particularly preferably from 0.050 to 0.100. When the ratio (C/D) is 0.001 or greater, toner particle strength is secured and a fracture that is caused due to a stress in the image formation is thus prevented, whereby a reduction in charges that is caused by exposure of the pigment from the toner particles, and fogging that is caused as a result thereof are prevented. Meanwhile, when the ratio (C/D) is equal to or smaller than 0.700, a high brilliance is easily obtained, compared to a case where the ratio thereof is greater than 0.700.

Angle Between Long Axis Direction of Toner Particles in Cross Section and Long Axis Direction of Brilliant Pigment Particles As shown in the requirement (2), when cross sections of toner particles in a thickness direction are observed, the rate (based on the number) of the metallic pigment in which an angle between a long axis direction of the toner particles in the cross section and a long axis direction of the metallic pigment is from −30° to +30° is preferably 60% or greater of the total number of metallic pigment particles that are observed. Furthermore, the rate is more preferably from 70% to 95%, and particularly preferably from 80% to 90% of the total number of metallic pigment particles that are observed.

When the rate described above is equal to or greater than 60%, an excellent brilliance is obtained.

Herein, the observation method of the cross sections of toner particles will be described.

Toner is embedded using a bisphenol A type liquid epoxy resin and a hardening agent, and then a cut sample is prepared.

Then, the cut sample is cut by using a cutter using a diamond knife (using LEICA Ultramicrotome (manufactured by Hitachi High-Technologies Corporation) in the exemplary embodiment) at −100° C., and an observation sample is prepared. With this observation sample, the cross sections of the toner particles are observed using a transmission electron microscope (TEM) at a magnification of about 5000-fold magnification. With the observed 1000 toners particles, the number of metallic pigments in which the angle between the long axis direction of the toner particles in cross section and the long axis direction of the metallic pigment is from −30° C. to +30° C., is counted using image analysis software, and the proportion thereof is calculated.

The "long axis direction of the toner particles in the cross section" indicates a direction perpendicular to the thickness direction of the toner particles having the average equivalent circle diameter D larger than the average maximum thickness C. The "long axis direction of the metallic pigment" indicates a length direction of the metallic pigment.

Volume Average Particle Size of Toner Particles

The volume average particle size of the toner particles is preferably from 1 μm to 30 μm, and more preferably from 3 μm to 20 μm. When the toner particles have a flake shape as in the toner particles of the exemplary embodiment, the value of the volume average particle size represents a volume average value of an equivalent spherical diameter.

In detail, regarding the volume average particle size $D_{50v}$, cumulative distributions by volume and by number are drawn from the side of the smallest size on the basis of particle size ranges (channels) separated based on the particle size distribution measured by a measuring machine such as a Multisizer II (manufactured by Beckman Coulter Inc.). The particle size when the cumulative percentage becomes 16% is defined as that corresponding to a volume $D_{16v}$ and a number $D_{16p}$. The particle size when the cumulative percentage becomes 50% is defined as that corresponding to a volume $D_{50v}$ and a number $D_{50p}$, and the particle size when the cumulative percentage becomes 84% is defined as that corresponding to a volume $D_{84v}$ and a number $D_{84p}$. Using these, a volume average particle size distribution index (GSDv) is calculated as $(D_{84v}/D_{16v})^{1/2}$.

Ti-Containing Particles

There is no particular limitation for the Ti-containing particles as long as the particles contain Ti elements and have a particular shape, and examples thereof include titanium oxide, titanium carbide, titanate, (magnesium salts, calcium salts, strontium salts, barium salts), and the like.

Specific examples of the Ti-containing particles include titanium oxide such as $TiO_2$ (titania), and $TiO(OH)_2$ (metatitanic acid); titanium carbide such as TiC (titanium carbide); titanate such as $CaTiO_3$ or $SrTiO_3$; and the like.

Among the Ti-containing particles, $TiO(OH)_2$ is preferable from a viewpoint that the "ratio of height/long axis" of the Ti-containing particles is easily reduced, $TiO_2$ is preferable from a viewpoint that the number average particle size is easily set in the range described above, and titanate (among these, particularly $SrTiO_3$) is preferable from a viewpoint that an high charge exchanging property is excellent.

The added amount of the Ti-containing particles is, for example, in a range of 0.1 part by weight to 1.5 parts by weight, is preferably from 0.1 part by weight to 0.8 parts by weight, and more preferably from 0.2 part by weight to 0.4 part by weight, with respect to 100 parts by weight of the toner particles. When the added amount of the Ti-containing particles is in the range described above, the effect of the reduction of the electrostatic adhesive force between the toner particles is easily obtained, compared to a case where the added amount thereof is smaller than the range described above, and the charge leakage of the toner surface is evenly promoted, compared to a case where the added amount thereof is greater than the range described above.

Other External Additive

The toner according to the exemplary embodiment may include other external additives.

Examples of other external additives include inorganic particles which does not contain the Ti element, and specific examples thereof include $SiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO. $SiO_2$, $Al_2O_3.2SiO_2$, $CaCO_3$, $MgCO_3$, $BaSO_4$, $MgSO_4$, and the like.

Surfaces of the inorganic particles used as the other external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

In addition to the inorganic particles, examples of the other external additive also include resin particles (resin particles such as polystyrene, PMMA, and melamine resin) and a cleaning aid (e.g., metal salt of higher fatty acid represented by zinc stearate, and fluorine-based polymer particles).

Toner Preparing Method

Next, a method of preparing a toner according to the exemplary embodiment will be described.

The toner according to the exemplary embodiment is obtained by externally adding an external additive to toner particles after preparing of the toner particles.

The method of preparing toner particles is not particularly limited, and toner particles are prepared by a known method such as a dry method, e.g., a kneading and pulverizing method or a wet method, e.g., an emulsion aggregating method and a dissolution and suspension method.

The kneading and pulverizing method is a method of mixing each material such as the metallic pigment and the like and then melting and kneading the material using a kneader, an extruder or the like, performing coarse pulverizing of the obtained melted and kneaded material, and then performing pulverization using a jet mill, and obtaining toner particles having a toner diameter in a target range by a wind classifier.

In more detail, the kneading and pulverizing method is divided into a kneading step of kneading a toner forming material including the metallic pigment and the binder resin, and a pulverization step of pulverizing the kneaded material. If necessary, the method may include a cooling step of cooling the kneaded material formed by the kneading step, or another step.

The dissolution and suspension method is a method of obtaining toner particles including: subjecting a liquid in which a material containing a binder resin, a metallic pigment, and if necessary other optional components such as a release agent is dissolved or dispersed in a solvent in which the binder resin is soluble to granulation in an inorganic dispersant-containing aqueous medium; and removing the solvent.

Examples of other components that are used in the dissolution and suspension method include various components such as a charge-controlling agent and organic particles, as well as a release agent.

In the exemplary embodiment, an emulsion aggregating method may be used in which the shape and the particle size of toner particles are easily controlled and the control range in the structure of toner particles such as a core-shell structure is also wide. Hereinafter, a method of preparing toner particles using an emulsion aggregating method will be described in detail.

The emulsion aggregating method according to the exemplary embodiment has an emulsification step of forming resin particles (emulsification particles) or the like by emulsifying raw materials constituting the toner particles, an aggregation step of forming aggregates of the resin particles, and a coalescence step of coalescing the aggregates.

Emulsification Step

A resin particle dispersion may be prepared using a general polymerization method such as an emulsion polymerization method, a suspension polymerization method, or a dispersion polymerization method. Otherwise, a resin particle dispersion may be prepared through emulsification by applying a shear force to a solution obtained by mixing an aqueous medium with a binder resin using a dispersing machine. In this case, particles may be formed by reducing the viscosity of the resin component by heating. In addition, a dispersant may be used in order to stabilize the dispersed resin particles. Furthermore, when a resin is soluble in an oily solvent having a relatively low solubility to water, the resin is dissolved in the solvent so that particles thereof are dispersed in the water together with a dispersant or a polyelectrolyte, and then heating or decompression is performed to evaporate the solvent, thereby preparing a resin particle dispersion.

Examples of the aqueous medium include water such as distilled water and ion exchange water; and alcohols. Water is preferably used.

Examples of the dispersant that is used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as anionic surfactants, e.g., sodium dodecylbenzenesulfonate, sodium octadecylsulfate, sodium oleate, sodium laurate, and potassium stearate, cationic surfactants, e.g., laurylamine acetate, stearyl amine acetate, and lauryl trimethyl ammonium chloride, zwitterionic surfactants, e.g., lauryl dimethyl amine oxide, and nonionic surfactants, e.g., polyoxyethylene alkyl ether, polyoxyethylene alkyl phenyl ether, and polyoxyethylene alkylamine; and inorganic salts such as tricalcium phosphate, aluminum hydroxide, calcium sulfate, calcium carbonate, and barium carbonate.

Examples of the dispersing machine that is used in the preparation of the emulsified liquid include a homogenizer, a homomixer, a pressure kneader, an extruder, and a media-dispersing machine. The size of the resin particles is preferably 1.0 μm or less, more preferably from 60 nm to 300 nm, and even more preferably from 150 nm to 250 nm in terms of the average particle size (volume average particle size). When the size is 60 nm or greater, the resin particles easily become unstable in the dispersion, and thus the resin particles may easily aggregate. When the size is 1.0 μm or less, the particle size distribution of the toner may be narrowed.

In the preparation of a release agent dispersion, a release agent is dispersed in water, together with an ionic surfactant or a polyelectrolyte such as a polymer acid or a polymer base, and then a dispersion treatment is performed using a homogenizer or a pressure discharge-type dispersing machine with which a strong shear force is applied, simultaneously with heating to a temperature that is not lower than the melting temperature of the release agent. A release agent dispersion is obtained through such a treatment. In the dispersion treatment, an inorganic compound such as polyaluminum chloride may be added to the dispersion. Examples of the preferable inorganic compound include polyaluminum chloride, aluminum sulfate, highly basic polyaluminum chloride (BAC), polyaluminum hydroxide, and aluminum chloride. Among these, polyaluminum chloride, aluminum sulfate, and the like are preferable.

Through the dispersion treatment, a release agent dispersion containing release agent particles having a volume average particle size of 1 μm or less is obtained. More preferably, the volume average particle size of the release agent particles is from 100 nm to 500 nm.

When the volume average particle size is 100 nm or greater, though it is also affected by the characteristics of the binder resin to be used, but generally, the release agent component is easily incorporated in the toner. When the volume average particle size is 500 nm or less, the release agent in the toner has a superior dispersion state.

In order to prepare a metallic pigment dispersion, a known dispersion method may be used and a general dispersion unit such as a rotary shearing-type homogenizer, a ball mill having media, a sand mill, a Dyno mill, or an Ultimizer may be employed, but there are no limits to the dispersion unit. The metallic pigment is dispersed in water, together with an ionic surfactant or a polyelectrolyte such as a polymer acid or a polymer base. The volume average particle size of the dispersed metallic pigment may be 20 μm or less. The volume average particle size is preferably from 3 μm to 16 μm, since the metallic pigment is dispersed well in the toner with no impairment in aggregability.

In addition, a metallic pigment and a binder resin may be dispersed and dissolved to be mixed with each other in a solvent, and dispersed in the water by phase inversion emulsification or shearing emulsification, thereby preparing a dispersion of metallic pigment coated with the binder resin.

Aggregation Step

In the aggregation step, a resin particle dispersion, a metallic pigment dispersion, a release agent dispersion, and the like are mixed to prepare a mixture, and heated to a temperature that is not higher than the glass transition temperature of the resin particles for aggregation, thereby forming aggregated particles. In many cases, in order to form the aggregated particles, the pH of the mixture is adjusted to acidic under stirring. By virtue of the above stirring conditions, the ratio (C/D) may be adjusted in a preferable range. More specifically, in the aggregated particle forming stage, when rapid stirring and heating are performed, the ratio (C/D) may be reduced, and when the stirring speed is reduced and the heating is performed at lower temperature, the ratio (C/D) may be increased. The pH is preferably from 2 to 7, at which an aggregating agent may also be effectively used.

Furthermore, in the aggregation step, the release agent dispersion may be added and mixed together with various dispersions such as a resin particle dispersion at a time or several times.

As the aggregating agent, a di- or higher-valent metal complex is preferably used, as well as a surfactant having an opposite polarity to the polarity of the surfactant that is used as the dispersant, and an inorganic metal salt. Since the amount of the surfactant to be used may be reduced and the charging characteristics are improved, a metal complex is particularly preferably used.

As the inorganic metal salt, aluminum salts and polymers thereof are particularly preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In the exemplary embodiment, a polymer of tetravalent inorganic metal salt including aluminum is preferably used to obtain a narrow particle size distribution.

In addition, when the aggregated particles have a desired particle size, the resin particle dispersion may be further added (coating step) to prepare a toner having a configuration in which a surface of a core aggregated particle is coated with a resin. In this case, the release agent or the metallic pigment is not easily exposed to the toner surface, and thus the configuration is preferable from the viewpoint of charging properties or developability. In the case of further addition, an aggregating agent may be added or the pH may be adjusted before further addition.

Coalescence Step

In the coalescence step, the progression of the aggregation is stopped by increasing the pH of the suspension of the aggregated particles to the range of 3 to 9 under stirring conditions based on the aggregation step, and the aggregated particles are coalesced by heating at a temperature that is not lower than the glass transition temperature of the resin.

In addition, in the case of coating with the resin, the resin is also coalesced and the core aggregated particles are coated therewith. Regarding the heating time, the heating may be performed to the extent that the coalescence is caused, and may be performed for 0.5 hour to 10 hours.

After coalescence, cooling is performed to obtain coalesced particles. In addition, in the cooling step, crystallization may be promoted by lowering the cooling rate at around the glass transition temperature of the resin (glass transition temperature±10° C.), that is, so-called slow cooling.

The coalesced particles obtained by coalescence are subjected to a solid-liquid separation step such as filtration, and if necessary, a washing step and a drying step, and thus toner particles are obtained.

The toner according to the exemplary embodiment is prepared by, for example, adding and mixing the Ti-containing particles (and if necessary, other external additives) with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

As described above, in the exemplary embodiment, since the effect of the reduction of the electrostatic adhesive force is obtained even when the Ti-containing particles are embedded in the toner particles, the Ti-containing particles may be strongly attached to the toner particles as the Ti-containing particles are embedded.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metal such as iron, nickel, cobalt, and the like, and magnetic oxide such as ferrite, magnetite, and the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as a conductive material.

Examples of the conductive materials include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100 (toner: carrier), and more preferably from 3:100 to 20:100.

Image Forming Apparatus and Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging step of charging a surface of an image holding member, an electrostatic charge image forming step of forming an electrostatic charge image on a charged surface of the image holding member, a developing step of developing the electrostatic charge image formed on the surface of the image holding member with the electrostatic charge image developer according to the exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image, a surface of an image holding member before charging; or an apparatus that is provided with an erasing unit that irradiates, after transfer of a toner image, a surface of an image holding member with erasing light before charging for erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that accommodates the electrostatic charge image developer according to the exemplary embodiment and is provided with a developing unit is preferably used.

In the exemplary embodiment, it is desirable to form an image by making the fixing member including a conductive material contact with the toner image to fix the toner image to the surface of the recording medium.

That is, in the image forming apparatus according to the exemplary embodiment, it is desirable that the fixing unit include a fixing member which includes a conductive material and contacts the toner image and fixes the toner image onto the surface of the recording medium.

In addition, in the image forming method according to the exemplary embodiment, it is desirable that the fixing step is a step of fixing the toner image onto the surface of the recording medium by making the fixing member including a conductive material contact with the toner image.

As described above, by making the fixing member including a conductive material contact with the toner image to fix the toner image to the surface of the recording medium, an image having a high brilliance is obtained even after deterioration of the toner. The reason thereof is not clear, but it is assumed that, since the fixing member which contacts the toner particles in the upright state includes the conductive material, the charge of the toner particles is more easily eliminated, and the electrostatic adhesive force between the toner particles is more easily reduced.

As the conductive material contained in the fixing member, conductive (for example, volume resistivity of less than $10^7$ Ω·cm, the same applies hereinafter) or semiconductive (for example, volume resistivity of $10^7$ Ω·cm to $10^{13}$ Ω·cm, the same applies hereinafter) powder (powder formed of particles having a primary particle diameter of less than 10 μm is desirable and powder formed of particles having a primary particle diameter of equal to or less than 1 μm is more desirable) is used.

Although there is no particular limitation, but the specific examples of the conductive material include carbon black (for example, Ketjen black, acetylene black, or carbon black having an oxidized surface), metal (for example, aluminum and nickel), a metal oxide compound (for example, yttrium oxide or tin oxide), ion conductive substances (for example, potassium titanate or lithium chloride), a conductive polymer (for example, polyaniline, polypyrrole, polysulfone, or polyacetylene), and the like.

The conductive material may be used alone or in combination of two or more kinds thereof.

The added amount of the conductive material may be adjusted so as to set surface resistivity of the surface of the fixing member which contacts the toner image or volume resistivity of the fixing member to desirable values.

The surface resistivity of the surface which contacts the toner image is, for example, from $1\times10^9$Ω/□ to $1\times10^{14}$Ω/□, and the volume resistivity of the fixing member is, for example, from $1\times10^8$ Ωcm to $1\times10^{13}$ Ωcm.

When the fixing member is an endless belt including a surface layer and the conductive material is contained in the surface layer, for example, the specific content of the conductive material is from 1% by weight to 50% by weight, preferably from 2% by weight to 40% by weight, and more preferably from 4% by weight to 30% by weight with respect to total components configuring the surface layer.

In the exemplary embodiment, an angle (hereinafter, referred to as a "contact angle" in some cases) formed by a contact surface of the fixing member at a position where the recording medium starts to contact the fixing member (hereinafter, referred to as a "contact start position" in some cases) in a direction opposite the proceeding direction of the recording medium is preferably from 5° to 20° with respect to the recording medium.

That is, in the image forming apparatus according to the exemplary embodiment, it is desirable that the contact angle of the fixing unit be in the range described above.

In addition, in the image forming method according to the exemplary embodiment, it is desirable that the fixing step be a step of fixing the toner image onto the recording medium so that the contact angle is in the range described above.

Figure 6:
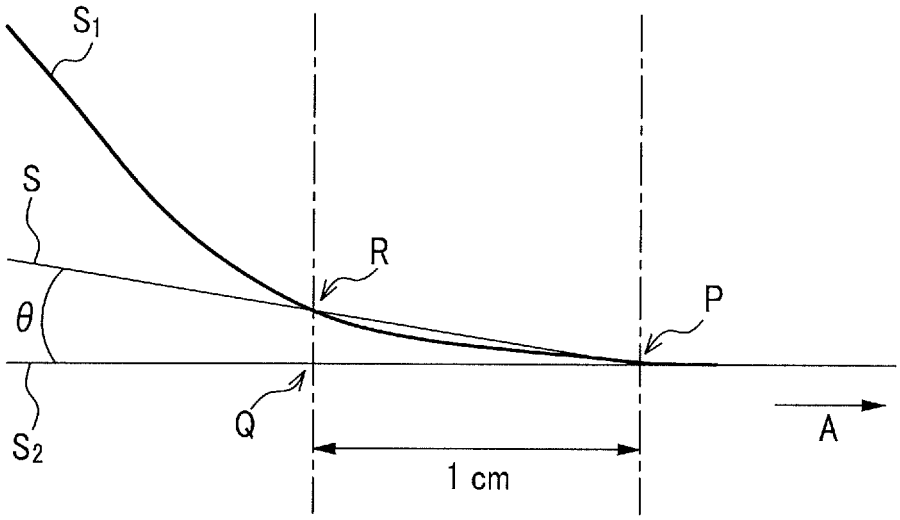
FIG. 6 is a schematic view for illustrating a contact angle.

As shown in FIG. 6, the "contact surface of the fixing member at the contact start position" herein is defined as a surface S obtained by linking a contact start position P at which a surface $S_1$ of the fixing member and a surface $S_2$ of the recording medium start to contact with each other, and a position R of the surface of the fixing member corresponding to a position Q which is 1 cm separated from the contact start position P to the side opposite the proceeding direction A of the recording medium. An angle θ formed by the surface S and the surface $S_2$ of the recording medium is the "contact angle".

When the contact angle described above is in the range described above, an image having a high brilliance is obtained, compared to a case where the contact angle is greater than the range described above.

As described above, in the toner image before passing through the contact start position (before contacting the fixing member), plural toner particles are considered to be arranged in the upright state due to the transfer electric field. The toner particles arranged in the proceeding direction of the recording medium successively pass through the contact start position. That is, the toner particles existing downstream of the recording medium in the proceeding direction (hereinafter, referred to as the "downstream toner particles" in some cases) previously contact the fixing member, and then the toner particles existing upstream of the recording medium in the proceeding direction (hereinafter, referred to as the "upstream toner particles" in some cases) contact the fixing member.

At that time, it is considered that, when the gap of the downstream toner particles and the upstream toner particles is narrower than the length of the long axis of the toner particles, the downstream toner particles lie due to the physical force of the fixing member so as to contact the upstream toner particles, and then the upstream toner particles lie due to the fixing member. As described above, it is considered that, when the upstream toner particles start to lie after the downstream toner particles contact the upstream toner particles in the upright state, a fixed image in which both of the toner particles are overlapped with each other is consequently obtained.

With respect thereto, it is considered that, when the contact angle is in the range described above, after the downstream toner particles contact the fixing member and before the downstream toner particles contact the upstream toner particles, the upstream toner particles contact the fixing member and start to lie. Accordingly, it is considered that, since the downstream toner particles hardly contact the upstream toner particles, and even in a case where the particles contact with each other, the downstream toner particles contact the upstream toner particles which started to lie, less amount of both of the toner particles are overlapped with each other.

Hereinafter, an example of the fixing device in which the contact angle is in the range described above will be described with reference to the drawings, but there is no limitation thereto.

Figure 3:
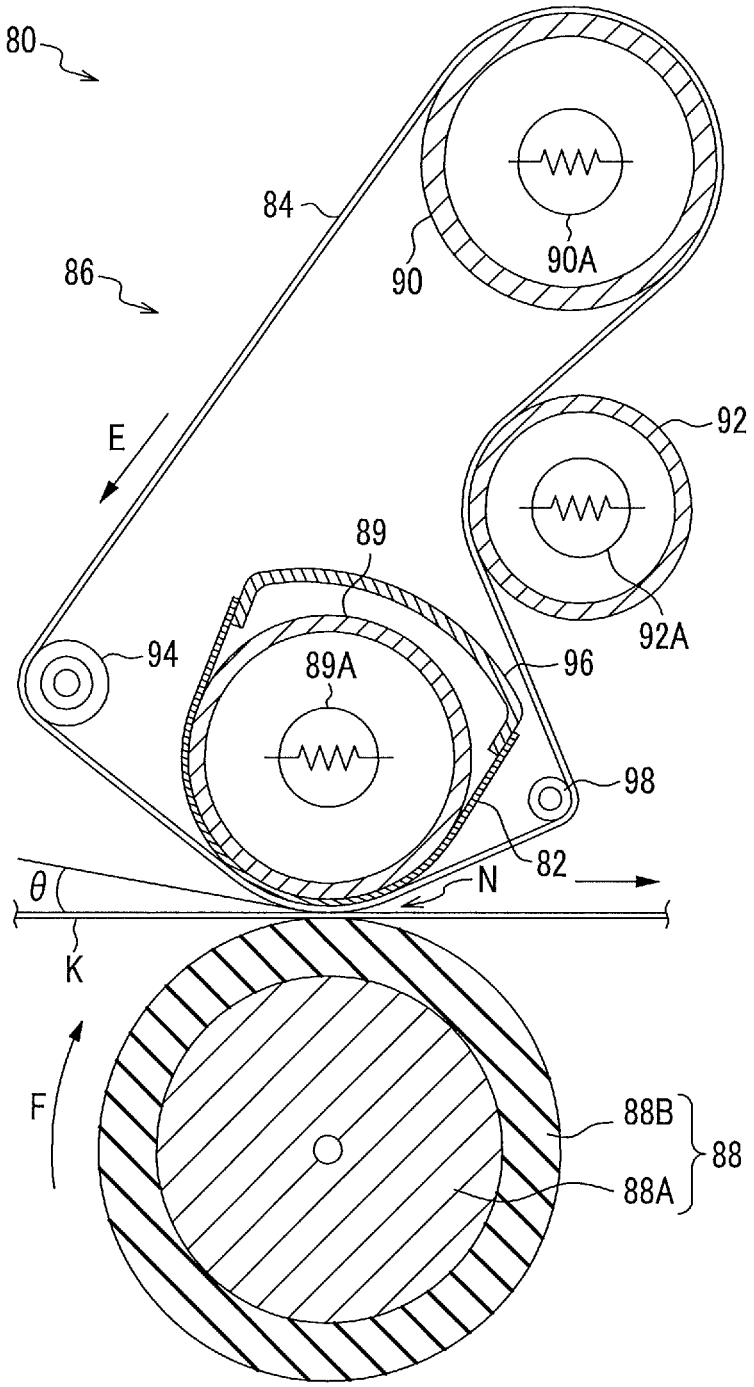
FIG. 3 is a schematic configuration diagram showing an example of a fixing device of an image forming apparatus of the exemplary embodiment.

FIG. 3 is a schematic diagram showing a configuration of a fixing device 80 in which the contact angle is in the range described above.

As shown in FIG. 3, the fixing device 80 is, for example, configured to include a fixing belt module 86 including a heating belt 84 as an example of the fixing member and a press roll 88 which is disposed to press by the heating belt 84 (fixing belt module 86). For example, a nipping area N (nipping unit) in which the heating belt 84 (fixing belt module 86) and the press roll 88 contact with each other is formed. In the nipping area N, a sheet K as an example of the recording medium is pressed and heated, and a toner image is fixed thereto.

The fixing belt module 86, for example, include the endless heating belt 84, a heating press roll 89 on which the heating belt 84 is wound on the press roll 88 side and which rotatably driven due to a rotational force of a motor (not shown) and presses the heating belt 84 to the press roll 88 side from the inner surface thereof, and a support roll 90 which supports the heating belt 84 from the inside in a position different from the heating press roll 89.

The fixing belt module 86, for example, include a support roll 92 which is disposed outside of the heating belt 84 and regulates a circuit path thereof, a posture correction roll 94 which corrects the posture of the heating belt 84 from the heating press roll 89 to the support roll 90 and presses the heating belt 84 to the press roll 88 side from the inner surface thereof, and a support roll 98 which applies tension to the heating belt 84 from the inner surface thereof, at downstream of the nipping area N which is an area in which the heating belt 84 (fixing belt module 86) and the press roll 88 contact with each other.

The fixing belt module 86 is provided so that a sheet-like sliding member 82 is interposed between the heating belt 84 and the heating press roll 89, for example.

The sliding member 82 is, for example, provided so that a slide surface thereof contacts the inner surface of the heating belt 84, and involved in holding and supplying a lubricant existing between the sliding member and the heating belt 84.

Herein, the sliding member 82 is, for example, provided so that both ends thereof are supported by supporting member 96.

The heating press roll 89 is a hard roll in which a fluorine resin coating film having a basis weight of 200 μm is formed on a core surface as a protection layer which prevents metal abrasion of the surface of a cylindrical core formed of aluminum.

A halogen heater 89A is, for example, provided inside of the heating press roll 89, as an example of a heating source.

The support roll 90 is a cylindrical roll formed of aluminum, includes a halogen heater 90A disposed at the inside thereof as an example of a heating source, and heats the heating belt 84 from the inner surface side.

Spring members (not shown) which press the heating belt 84 to the outer side are, for example, provided on both end portions of the support roll 90.

The support roll 92 is, for example, a cylindrical roll formed of aluminum and a release layer formed of a fluorine resin with a thickness of 20 μm is formed on the surface of the support roll 92.

The release layer of the support roll 92 is, for example, formed in order to prevent deposit of toner or paper powder from the outer periphery surface of the heating belt 84 on the support roll 92.

A halogen heater 92A is, for example, provided on the inner portion of the support roll 92 as an example of a heating source, and heats the heating belt 84 from the outer periphery surface side.

That is, for example, the heating belt 84 is heated by the heating press roll 89, the support roll 90, and the support roll 92.

The posture correction roll 94 is, for example, a columnar roll formed of aluminum, and an end portion position measurement mechanism (not shown) for measuring an end portion position of the heating belt 84 is disposed in the vicinity of the posture correction roll 94.

An axis displacement mechanism (not shown) for displacing the contacting position of the heating belt 84 in an axial direction depending on the measurement results of the end portion position measurement mechanism is disposed on the posture correction roll 94, and meandering of the heating belt 84 is controlled.

Meanwhile, the press roll 88 has a configuration in which an elastic layer 88B formed of silicone rubber and a peeling layer including a fluorine resin having a film thickness of 100 μm are laminated in order from a base side, using a columnar roll 88A formed of aluminum as a base. In addition, the press roll 88 is rotatably supported, and is provided to be pressed at a portion where the heating belt 84 is wound around the heating press roll 89, by a pushing unit such as spring (not shown). Accordingly, the press roll is rotatably moved in an arrow F direction following the heating belt 84 (heating press roll 89), in accordance with the rotation movement of the heating belt 84 (heating press roll 89) of the fixing belt module 86 in an arrow E direction.

The sheet K including an unfixed toner image is guided to the nipping area N of the fixing device 80 and the image is fixed by pressure and heat acting in the nipping area N.

The contact start position of the fixing device 80 of FIG. 3 is a position in the nipping area N, where the unfixed toner image on the sheet K starts to contact the heating belt 84. In addition, as shown in FIG. 3, the contact angle is an angle θ formed by the contact surface (surface contacting the sheet K) of the heating belt 84 in the contact start position in the direction opposite the proceeding direction of the sheet K.

Hereinabove, the fixing device including the fixing belt module including the heating belt and the press roll has been described as an example of the fixing device in which the contact angle is in the range described above, but there is no limitation thereto, and a fixing device using a press belt instead of the press roll may be used, or a fixing device using a fixing roll as the fixing member contacting the toner image may be used.

In addition, the image forming apparatus of the exemplary embodiment is not limited to an apparatus using the fixing device in which the contact angle is in the range described above, and other well-known image forming apparatus may be used.

Hereinafter, an example of the image forming apparatus according to the exemplary embodiment will be described, but there is no limitation thereto. Major parts shown in the drawings will be described, but descriptions of other parts will be omitted.

Figure 4:
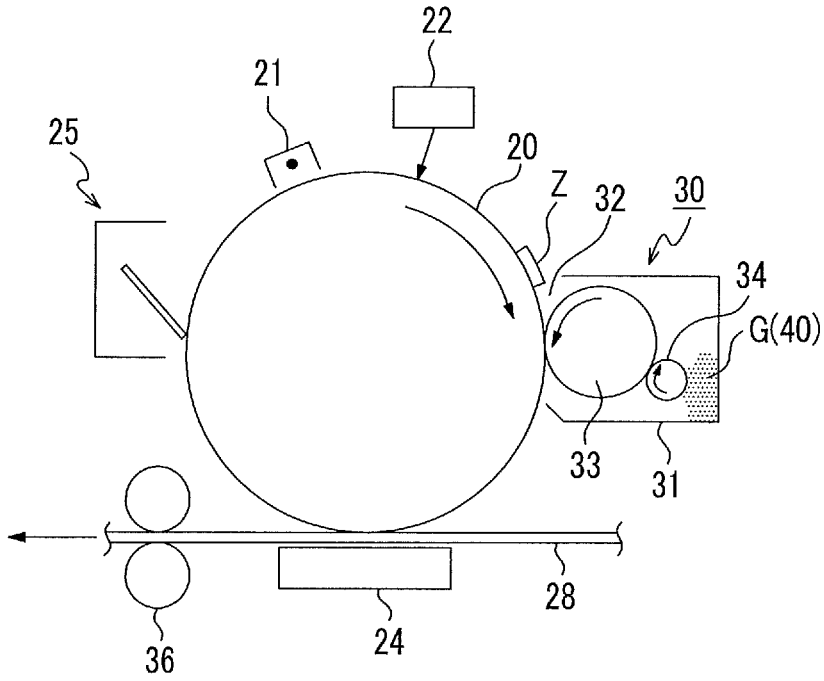
FIG. 4 is a schematic configuration diagram showing an example of an image forming apparatus of the exemplary embodiment.

FIG. 4 is a schematic configuration diagram showing an example of the image forming apparatus according to the exemplary embodiment including a developing device using the electrostatic charge image developer according to the exemplary embodiment.

In the drawing, the image forming apparatus according to the exemplary embodiment includes a photoreceptor 20 as an image holding member which rotates in a predetermined direction, and around this photoreceptor 20, a charging device 21 (an example of the charging unit) which charges the photoreceptor 20 (an example of the image holding member), an exposure device 22 (an example of the electrostatic charge image forming unit), for example, as an electrostatic charge image forming device which forms an electrostatic charge image Z on the photoreceptor 20, a developing device 30 (an example of the developing unit) which visualizes the electrostatic charge image Z formed on the photoreceptor 20, a transfer device 24 (an example of the transfer unit) which transfers a toner image which is visualized on the photoreceptor 20 to a recording sheet 28 which is a recording medium, and a cleaning device 25 (an example of the cleaning unit) which cleans toner remaining on the photoreceptor 20 are disposed in order.

In the exemplary embodiment, as shown in FIG. 4, the developing device 30 has a developing container 31 that contains a developer G including a toner 40. This developing container 31 has a developing opening 32 formed to be opposed to the photoreceptor 20, and a developing roll (developing electrode) 33 as a toner holding member arranged to face the developing opening 32. When a predetermined developing bias is applied to the developing roll 33, a developing electric field is formed in a region (developing region) sandwiched between the photoreceptor 20 and the developing roll 33. In the developing container 31, a charge injection roll (injection electrode) 34 as a charge injection member is provided to be opposed to the developing roll 33. Particularly, in the exemplary embodiment, the charge injection roll 34 also acts as a toner supply roll for supplying the toner 40 to the developing roll 33.

Herein, the charge injection roll 34 may be rotated in an arbitrarily selected direction, but in consideration of supply properties of the toner and charge injection properties, it is preferable that the charge injection roll 34 be rotated in the same direction as that of the developing roll 33 at a part opposed to the developing roll 33 with a difference in the peripheral velocity (for example, 1.5 times or greater), and the toner 40 be interposed in a region sandwiched between the charge injection roll 34 and the developing roll 33 and rubbed to inject charges.

Next, an operation of the image forming apparatus according to the exemplary embodiment will be described.

When an image forming process is started, first, the surface of the photoreceptor 20 is charged by the charging device 21, the exposure device 22 writes an electrostatic charge image Z on the charged photoreceptor 20, and the developing device 30 visualizes the electrostatic charge image Z as a toner image. Then, the toner image on the photoreceptor 20 is transported to a transfer site, and the transfer device 24 electrostatically transfers the toner image on the photoreceptor 20 onto a recording sheet 28 as a recording medium. The toner remaining on the photoreceptor 20 is cleaned by the cleaning device 25. Thereafter, the toner image on the recording sheet 28 is fixed by a fixing device 36 (an example of the fixing unit) to obtain an image.

Process Cartridge/Toner Cartridge

A process cartridge according to the exemplary embodiment will be described.

The process cartridge according to the exemplary embodiment is a process cartridge which includes a developing unit which accommodates the electrostatic charge image developer according to the exemplary embodiment and develops an electrostatic charge image formed on a surface of an image holding member as a toner image by the electrostatic charge image developer, and is detachable from the image forming apparatus.

Without being limited to the configuration described above, the process cartridge according to the exemplary embodiment may have a configuration including a developing device and, if necessary, at least one selected from other units such as the image holding member, the charging unit, an electrostatic charge image forming unit, and a transfer unit.

Hereinafter, an example of the process cartridge according to the exemplary embodiment will be shown. However, there is no limitation thereto. Major parts shown in the drawings will be described, but descriptions of other parts will be omitted.

Figure 5:
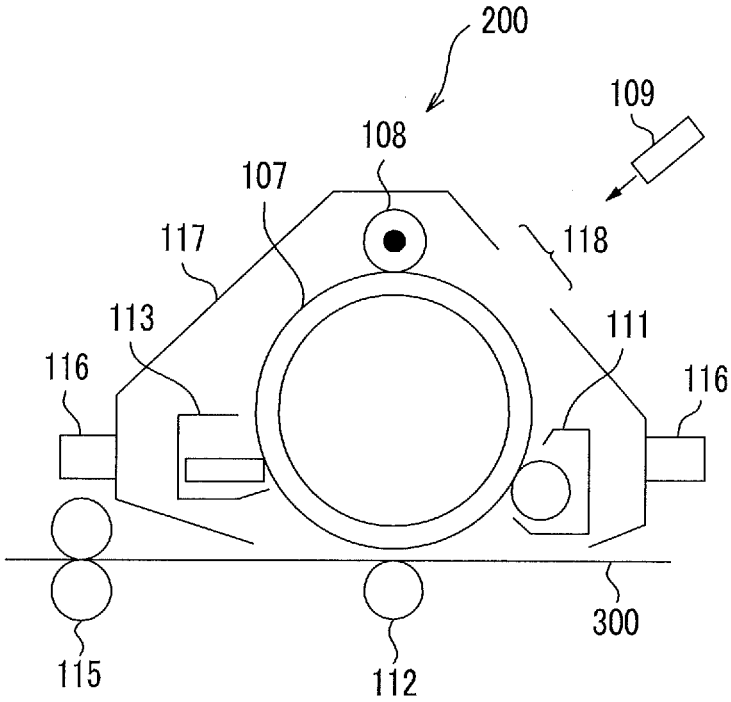
FIG. 5 is a schematic configuration diagram showing an example of a process cartridge of the exemplary embodiment.

FIG. 5 is a schematic configuration diagram showing the process cartridge according to the exemplary embodiment.

A process cartridge 200 shown in FIG. 5 is, for example, configured by integrally combining and holding a photoreceptor 107 (an example of image holding member), a charging roll 108 (an example of charging unit), a developing device 111 (an example of developing unit), and a photoreceptor cleaning device 113 (an example of cleaning unit) which are provided around the photoreceptor 107, by attachment rails 116 and a housing 117 with an opening portion 118 for exposure, and is configured as a cartridge.

In FIG. 5, reference numeral 109 denotes an exposure device (an example of electrostatic charge image forming unit), reference numeral 112 denotes a transfer device (an example of transfer unit), reference numeral 115 denotes a fixing device (an example of fixing unit), and reference numeral 300 denotes a recording sheet (an example of recording medium).

Next, a toner cartridge according to the exemplary embodiment will be described. The toner cartridge according to the exemplary embodiment may be configured so as to accommodate the brilliant toner according to the exemplary embodiment and to be detachable from the image forming apparatus. At least the toner may be accommodated in the toner cartridge according to the exemplary embodiment, and a developer, for example, may be accommodated therein, depending on a mechanism of the image forming apparatus.

The image forming apparatus shown in FIG. 4 has a configuration in which a toner cartridge (not shown) is detachably mounted thereon, and the developing device 30 is connected to the toner cartridge via a toner supply tube (not shown). In addition, when the toner accommodated in the toner cartridge runs low, the toner cartridge may be replaced.

Examples

Hereinafter, the exemplary embodiment will be described in more detail using examples, but is not limited to the following examples. Unless otherwise noted, "parts" and "%" are based on weight.

Preparation of Toner

Preparation of Toner Particles (1)

Synthesis of Binder Resin

Bisphenol A ethylene oxide 2-mol adduct: 216 parts

Ethylene glycol: 38 parts

Terephthalic acid: 200 parts

Tetrabutoxytitanate (catalyst): 0.037 part

The above components are put in a two-necked flask which is dried by heating, nitrogen gas is introduced in a container to maintain an inert atmosphere, and the components are heated while stirring, and then are subjected to co-condensation polymerization reaction for 7 hours at 160° C., and then a temperature thereof is increased to 220° C. while slowly reducing pressure thereof to 10 Torr and those are maintained for 8 hours. The pressure is temporarily returned to normal pressure, 9 parts of trimellitic anhydride is added, and the pressure thereof is slowly reduced again to 10 Torr and maintained for 2 hours at 220° C., to synthesize the binder resin.

Preparation of Resin Particle Dispersion

Binder resin: 160 parts

Ethyl acetate: 233 parts

Sodium hydroxide aqueous solution (0.3 N): 0.1 part

The above components are put in a 1000 ml separable flask, heated at 70° C., and stirred with Three-One Motor (manufactured by Shinto Scientific Co., Ltd.) to prepare a resin mixed liquid. The resin mixed liquid is further stirred, 373 parts of the ion exchange water is slowly added therein to perform phase inversion emulsification, and the solvent thereof is removed to obtain a resin particle dispersion (solid content concentration: 30%).

Preparation of Release Agent Dispersion

Carnauba wax (RC-160 manufactured by Toa Kasei Co., Ltd.): 50 parts

Anionic surfactant (NEOGEN RK manufactured by Dai-Ichi Kogyo Seiyaku Co., Ltd.): 1.0 part Ion exchange water: 200 parts The above components are mixed with each other and heated to 95° C., dispersed using a homogenizer (ULTRA-TURRAX T50 manufactured by IKA Ltd.), and then are subjected to dispersion treatment with Manton-Gaulin high pressure homogenizer (manufactured by Gaulin Co., Ltd.) for 360 minutes, and thereby preparing a release agent dispersion (solid content concentration: 20%) in which the release agent particles having the volume average particle diameter of 0.23 μm are dispersed.

Preparation of Brilliant Pigment Particle Dispersion

Aluminum pigment (2173EA manufactured by SHOWA ALUMINUM POWDER K.K): 100 parts

Anionic surfactant (NEOGEN R manufactured by Dai-Ichi Kogyo Seiyaku Co., Ltd.): 1.5 parts Ion exchange water: 900 parts After removing a solvent from the paste of the aluminum pigment, the above components are mixed and dispersed for 1 hour using an emulsifying disperser CAVITRON (CR1010 manufactured by Pacific Machinery & Engineering Co., Ltd.), and a brilliant pigment particle dispersion (solid content concentration: 10%) in which the brilliant pigment particles (particles of metal pigments) which are particles of the aluminum pigment are dispersed is prepared.

The value of the ratio (C/D) of the particles of the aluminum pigment which is the metal pigment is 0.01 and the volume resistivity thereof is $1\times10^{-3}$ Ω·cm.

Preparation of Toner Particles

Resin particle dispersion: 450 parts

Release agent dispersion: 50 parts

Brilliant pigment particle dispersion: 21.74 parts

Nonionic surfactant (IGEPAL CA897): 1.40 parts

The above raw materials are put in a 2 L cylindrical stainless container, dispersed and mixed for 10 minutes while applying a shear force at 4000 rpm using a homogenizer (ULTRA-TURRAX T50 manufactured by IKA Ltd.). Then, 1.75 parts of 10% nitric acid aqueous solution of polyaluminum chloride is slowly added dropwise as an aggregating agent, the resultant material is dispersed and mixed for 15 minutes by setting a rotating speed of the homogenizer to 5000 rpm, and is set as a raw material dispersion.

After that, the raw material dispersion is put in a polymerization tank including a stirring device using stirring blades of two paddles for forming a laminar flow and a thermometer, heating is started with a mantle heater by setting a stirring rotation speed to 810 rpm, and growth of aggregated particles is promoted at 54° C. At that time, pH of the raw material dispersion is controlled to be in a range of 2.2 to 3.5 with 0.3N nitric acid and 1 N sodium hydroxide aqueous solution. The raw material dispersion is maintained in the pH range described above for 2 hours and the aggregated particles are formed. At that time, the volume average particle size of the aggregated particles measured using Multisizer II (aperture size: 50 μm, manufactured by Beckman Coulter K.K) is 10.4 μm.

Next, 100 parts of the resin particle dispersion is further added and the resin particles of the binder resin are attached to the surface of the aggregated particles. In addition, the temperature thereof is increased to 56° C., the aggregated particles are prepared while confirming the size and form of the particle with an optical microscope and Multisizer II. Then, after increasing pH to 8.0 for coalescing the aggregated particles, the temperature thereof is increased to 67.5° C. After confirming that the aggregated particles are coalesced with the optical microscope, pH thereof is decreased to 6.0 while maintaining the temperature at 67.5° C., the heating is stopped after 1 hour, and cooling is performed at a temperature falling rate of 1.0° C./min. Then, after performing sieving with mesh of 20 μm and repeating water washing, the resultant material is dried with a vacuum drying machine to obtain toner particles (1).

Preparation of Toner Particles (2) Toner particles (2) are prepared in the same manner as in the preparation of the toner particles (1), except for changing the stirring rotation speed in the step of promoting the growth of aggregated particles from 810 rpm to 600 rpm and changing the temperature in the step of coalescing the aggregated particles from 67.5° C. to 74° C.

Preparation of Toner Particles (3)

Toner particles (3) are prepared in the same manner as in the preparation of the toner particles (1), except for changing the stirring rotation speed in the step of promoting the growth of aggregated particles from 810 rpm to 520 rpm and changing the temperature in the step of coalescing the aggregated particles from 67.5° C. to 80° C.

Regarding the obtained toner particles (1) to (3), the value of the ratio (C/D) ("ratio (C/D)" in Table 1), a rate of the metal pigment in which the angle between the long axis direction of the toner particles in the cross section in the thickness direction and the long axis direction of the metallic pigment is from −30° to +30° ("orientation of pigment" in Table 1), and the volume average particle size (μm) are shown in Table 1.

Preparation of Ti-Containing Particles 1

Ti-containing particles 1 are prepared as follows.

In detail, ilmenite as mineral ore is dissolved in sulfuric acid to separate iron, the obtained $TiOSO_4$ is hydrolyzed and washing with water is performed until pH of the filtrated liquid becomes constant. 3N hydrochloric acid is added thereto, after adjusting pH to 6.5 to 7, strong sulfuric acid is added thereto, the concentration of hydrochloric acid is adjusted to 110 g/L and the concentration of $TiO_2$ is adjusted to 50 g/L, the resultant material is stirred at 30° C. for 2 hours and then left, to prepare $TiO(OH)_2$ slurry. 38 parts by weight of tert-butyltrimethoxysilane is mixed with respect to 100 parts (in terms of $TiO(OH)_2$) of the obtained $TiO(OH)_2$, followed by stirring at 80° C. for 30 minutes, 7N sodium hydroxide aqueous solution is added thereto to neutralize pH to 6.8, and filtration and water washing are performed using a suction funnel. Then, after drying the resultant material at 120° C. for 10 hours, soft aggregates are separated into pieces with a pin mill, and Ti-containing particles 1 are prepared.

Preparation of Containing Particles 2

400 g of 48% sodium hydroxide aqueous solution is added over 1 hour while stirring with respect to titanium dioxide hydrate cake (solid content of 50%, containing 100 g in terms of $TiO_2$) obtained with a sulfate method, followed by heating and stirring at 100° C. for 3 hours. The slurry is suctioned and filtrated, and subjected to water washing until pH of the filtrated liquid is 6.5 to 7.0. Aqueous slurry with $TiO_2$ conversion concentration of 100 g/L is prepared, and 30% hydrochloric acid is added to adjust pH to 6.8. The slurry is heated to 45° C., 35% hydrochloric acid is added at this temperature, and the concentration of hydrochloric acid in the slurry is adjusted to 35 g/L. After further heating at 100° C. for 3 hours, ammonia water is added to adjust pH to 6.8. This slurry is suctioned and filtrated and subjected to water washing until pH of the filtrated liquid is 6.5 to 7.0. After drying, the soft aggregates are separated into pieces with a pin mill, and Ti-containing particles 2 are prepared.

Preparation of Containing Particles 3

The obtained Ti-containing particles 2 are heated and dried at 300° C. for 15 minutes (under the nitrogen atmosphere), and Ti-containing particles 3 are prepared.

Preparation of Ti-Containing Particles 4

400 g of 48% sodium hydroxide aqueous solution is added over 1 hour while stirring with respect to titanium dioxide hydrate cake (solid content of 50%, containing 100 g in terms of $TiO_2$) obtained with a sulfate method, followed by heating and stirring at 100° C. for 3 hours. The slurry is suctioned and filtrated, and subjected to water washing until pH of the filtrated liquid is 6.5 to 7.0. Aqueous slurry with $TiO_2$ conversion concentration of 100 g/L is prepared, and 30% hydrochloric acid is added to adjust pH to 1.3. A SrCl aqueous solution is added to the cake obtained by suctioning and filtrating this slurry to adjust a molar ratio of $SrO/TiO_2$ to 1.3. This slurry is heated at 85° C. for 2 hours and 48% sodium hydroxide aqueous solution is added thereto and heating and mixing are continued for 20 hours. Then, suction and filtration are performed and water washing is repeated until pH of the filtrated liquid becomes constant. The obtained cake is heated and dried at 110° C., and Ti-containing particles 4 are obtained.

Preparation of Ti-Containing Particles 5

Ti-containing particles 5 are obtained in the same manner as the Ti-containing particles 4, except for heating and mixing at 90° C. for 48 hours the slurry in which a molar ratio of $SrO/TiO_2$ is adjusted to 1.3.

Preparation of Ti-Containing Particles 6

Ti-containing particles 6 are obtained in the same manner as the Ti-containing particles 1, except for adjusting the concentration of $TiO_2$ to 100 g/L.

Preparation of Ti-Containing Particles 7 Ti-containing particles 7 are obtained in the same manner as the Ti-containing particles 1, except for adjusting the concentration of $TiO_2$ to 150 g/L.

Preparation of Other External Additive 1 ($SiO_2$ Particles)

As the other external additive 1, irregular shaped $SiO_2$ particles (product name: RX 50 manufactured by Nippon Aerosil Co., Ltd.) are used.

The moisture content, the number average particle size, the value of the "ratio of height/long axis" of the Ti-containing particles, which are acquired with the methods described above, are shown in Table 1

Preparation of Toner 0.4 part of the external additive disclosed in Table 1 is added and mixed to 100 parts of the toner particles disclosed in Table 1 with the Henschel mixer and each toner used in Examples and Comparative Examples is obtained.

The value of the ratio (C/D) disclosed in Table 1 is measured with the toner particles 1, 2, and 3 (that is, measured before adding the external additive).

Preparation of Carrier

- Ferrite particles (volume average particle size: 35 μm): 100 parts
- Toluene: 14 parts
- Perfluoroacrylate copolymer (critical surface tension: 24 dyn/cm): 1.6 parts
- Carbon black (product name: VXC-72 manufactured by Cabot Corporation, volume resistivity: 100 Ωcm or lower): 0.12 part
- Crosslinked melamine resin particles (average particle size: 0.3 μm, toluene-insoluble): 0.3 part First, carbon black is diluted with toluene and added to the perfluoroacrylate copolymer and dispersed with a sand mill. Then, each component other than the ferrite particles is dispersed therein with a stirrer for 10 minutes, and a coating layer forming solution is prepared. Then, after putting the coating layer forming solution and the ferrite particles in a vacuum deaeration type kneader and stirring for 30 minutes at a temperature of 60° C., the pressure is reduced and toluene is distilled to form a resin coating layer and obtain a carrier.

Preparation of Developer 36 parts of the toner and 414 parts of the carrier are put in 2 liter V-blender, stirred for 20 minutes, and then sieved with mesh of 212 μm to prepare a developer.

Evaluation Test

Evaluation A of Brilliance

A solid image is obtained with the following method.

A developer unit of a modified DocuCentre-III C7600 (manufactured by Fuji Xerox Co., Ltd.) is filled with a developer that is a sample, and 5 cm×5 cm solid images having a toner applied amount of 4.0 g/cm$^2$ are continuously formed on 10,000 recording sheets (OK TopCoat plus Paper manufactured by Oji Paper Co., Ltd.) at the fixing temperature of 190° C. and the fixing load of 4.0 kg/cm$^2$, after performing seasoning for a night in the environment of a high temperature and low humidity (35° C. 50 RH %).

The ratio (A/B) of tenth and ten thousandth solid images are measured with the following method. The value of the ratio (A/B) of the tenth solid image is an "initial ratio (A/B)" and the value of the ratio (A/B) of the ten thousandth solid image is a "physical load-applied ratio (A/B)". The results are shown in Table 1.

The fixing device mounted on the image forming apparatus used herein includes a fixing member having the following configuration and characteristics and the contact angle is 27°.

Configuration of Fixing Member

Base: thermosetting polyimide

Surface layer: layer of a tetrafluoroethylene-perfluoroalkyl vinyl ether copolymer (PFA) containing graphite (graphite powder: ACP manufactured by Nippon Graphite Industries, Ltd.) as a conductive material to be 3% by weight of the total components Characteristics of Fixing Member Surface resistivity: $1\times10^{14}\Omega/\square$ Volume resistivity: $1\times10^{13}$ Ωcm Measurement of Ratio (A/B)

Incident light at an angle of incidence of −45° to the solid image is applied on an image part of the formed solid image by using a spectral varied angle color-difference meter GC5000L manufactured by Nippon Denshoku Industries Co., Ltd. as a goniophotometer, and a reflectance A at a light-receiving angle of +30° and a reflectance B at a light-receiving angle of −30° are measured. Each of the reflectance A and the reflectance B is measured for light having a wavelength of 400 nm to 700 nm at intervals of 20 nm, and defined as an average value of the reflectances at respective wavelengths. The ratio (A/B) is calculated from these measurement results.

Evaluation B of Brilliance

The evaluation B of brilliance is performed in the same manner as in the evaluation A of brilliance, except for using an image forming apparatus including the fixing member having the following configuration and characteristics and on which the fixing device having the contact angle of 27° is mounted.

Configuration of Fixing Member

Base: thermosetting polyimide

Surface layer: layer of a tetrafluoroethylene-perfluoroalkyl vinyl ether copolymer (PFA) containing graphite (graphite powder: ACP manufactured by Nippon Graphite Industries, Ltd.) as a conductive material to be 10% by weight of the total components Characteristics of Fixing Member Surface resistivity: $1\times10^{9}\Omega/\square$ Volume resistivity: $1\times10^{8}$ Ωcm Evaluation C of Brilliance The evaluation C of brilliance is performed in the same manner as in the evaluation A of brilliance, except for using an image forming apparatus including the fixing member having the following configuration and characteristics and on which the fixing device having the contact angle of 15° is mounted.

Configuration of Fixing Member

Base: thermosetting polyimide

Surface layer: layer of a tetrafluoroethylene-perfluoroalkyl vinyl ether copolymer (PFA) containing graphite (graphite powder: ACP manufactured by Nippon Graphite Industries, Ltd.) as a conductive material to be 10% by weight of the total components Characteristics of Fixing Member Surface resistivity: $1\times10^{9}\Omega/\square$ Volume resistivity: $1\times10^{8}$ Ωcm

TABLE 1

| | | Toner particles | | | | Ti-containing particles | | | | Evaluation of brilliance: ratio (A/B) | | | | | |
|---|---|---|---|---|---|---|---|---|---|---|---|---|---|---|---|
| | | | | | | | | | | Evaluation A | | Evaluation B | | Evaluation C | |
| | | Ratio (C/D) | Orientation of pigment | No. | Volume average particle size (μm) | Moisture content (% by weight) | Number average particle size (nm) | Ratio of height/long axis | No. | Initial stage | After physical load is applied | Initial stage | After physical load is applied | Initial stage | After physical load is applied |
| Ex. | 1 | 0.075 | 85 | 1 | 12.5 | 5.5 | 30 | 0.5 | 1 | 65 | 63 | 68 | 63 | 70 | 68 |
| | 2 | 0.208 | 70 | 2 | 13.0 | 5.5 | 30 | 0.5 | 1 | 25 | 20 | | | | |
| | 3 | 0.45 | 62 | 3 | 12.2 | 5.5 | 30 | 0.5 | 1 | 6 | 3 | | | | |
| | 4 | 0.075 | 85 | 1 | 12.5 | 2.5 | 20 | 0.4 | 2 | 67 | 38 | | | | |
| | 5 | 0.075 | 85 | 1 | 12.5 | 1.0 | 20 | 0.4 | 3 | 68 | 18 | | | | |
| | 6 | 0.075 | 85 | 1 | 12.5 | 6.0 | 40 | 0.7 | 4 | 61 | 35 | | | | |
| | 7 | 0.075 | 85 | 1 | 12.5 | 5.5 | 55 | 0.7 | 5 | 65 | 15 | | | | |
| | 8 | 0.075 | 85 | 1 | 12.5 | 5.3 | 35 | 0.4 | 6 | 63 | 18 | 68 | 50 | 70 | 58 |
| | 9 | 0.075 | 85 | 1 | 12.5 | 5.6 | 25 | 0.8 | 7 | 66 | 13 | 70 | 30 | 68 | 50 |
| Com. Ex. | 1 | 0.075 | 85 | 1 | 12.5 | — | — | — | — | 67 | 1 | | | | |

In Table, "—" indicates that the Ti-containing particles are not contained, and the empty space indicates that the evaluation is not performed.

From the results described above, it is found that, in the examples, an image having a high brilliance is obtained even after the physical load is applied, compared to the comparative examples.

In addition, from the results described above, when an image is formed under the conditions of the evaluation B of brilliance, it is found that an image having a high brilliance is obtained even after the physical load is applied, compared to a case where an image is formed under the conditions of the evaluation A of brilliance.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

flake shape toner particles containing a binder resin, and a flake shape metallic pigment; and tabular particles containing a Ti element.

2. The brilliant toner according to claim 1, wherein a moisture content of the tabular particles is from 1% by weight to 10% by weight.

3. The brilliant toner according to claim 1, wherein a value of height/long axis of the tabular particles is from 0.1 to 0.7.

4. The brilliant toner according to claim 1, wherein a number average particle size of the tabular particles is from 7 nm to 50 nm.

5. The brilliant toner according to claim 1, wherein a ratio (C/D) of an average maximum thickness C and an average equivalent circle diameter D of the toner particles is from 0.001 to 0.500.

6. The brilliant toner according to claim 1, wherein a ratio (C/D) of an average maximum thickness C and an average equivalent circle diameter D of the toner particles is from 0.001 to 0.200.

7. The brilliant toner according to claim 1, wherein a value of height/long axis of the tabular particles is greater than a value of a ratio (C/D) of an average maximum thickness C and an average equivalent circle diameter D of the toner particles.

8. The brilliant toner according to claim 1, wherein a value of height/long axis of the tabular particles is 1.1 times to 25 times the value of a ratio (C/D) of an average maximum thickness C and an average equivalent circle diameter D of the toner particles.

9. An electrostatic charge image developer comprising the brilliant toner according to claim 1.

10. A toner cartridge that accommodates the brilliant toner according to claim 1, and is detachable from an image forming apparatus.

11. A process cartridge comprising:

a developing unit that accommodates the electrostatic charge image developer according to claim 9 and develops an electrostatic charge image formed on a surface of an image holding member with the electrostatic charge image developer as a toner image, in which the process cartridge is detachable from an image forming apparatus.

* * * * *